United States Patent [19]

Turner

[11] Patent Number: 4,949,865

[45] Date of Patent: Aug. 21, 1990

[54] CONTAINER LID WITH INTEGRAL STOPPER

[75] Inventor: Donald R. Turner, Shelbyville, Ind.

[73] Assignee: Williams Industries, Inc., Shelbyville, Ind.

[21] Appl. No.: 459,527

[22] Filed: Jan. 2, 1990

[51] Int. Cl.[5] ..... B65D 41/32

[52] U.S. Cl. ..... 220/90.4; 220/90.2; 220/254; 220/335; 220/337; 220/339

[58] Field of Search ..... 220/90.2, 90.4, 90.6, 220/254, 263, 264, 269, 335, 337, 339

[56] References Cited

U.S. PATENT DOCUMENTS

| | | | |
|---|---|---|---|
| D. 267,633 | 1/1983 | Christian . | |
| 3,744,662 | 7/1973 | Zundel . | |
| 4,094,433 | 6/1978 | Numbers | 220/90.4 |
| 4,190,173 | 2/1980 | Mason et al. . | |
| 4,202,459 | 5/1980 | DeParales et al. . | |
| 4,361,250 | 11/1982 | Foster . | |
| 4,566,605 | 1/1986 | Rogers | 220/90.2 |
| 4,629,088 | 12/1986 | Durgin . | |
| 4,699,290 | 10/1987 | Adams . | |
| 4,738,373 | 4/1988 | DeParales | 220/254 |
| 4,741,450 | 5/1988 | Braude | 220/90.4 |
| 4,760,934 | 8/1988 | Netsch . | |

*Primary Examiner*—Stephen Marcus
*Assistant Examiner*—Stephen Cronin
*Attorney, Agent, or Firm*—Barnes & Thornburg

[57] ABSTRACT

A lid to cover a liquid holding container includes a circular rim portion for engaging the container rim and a cover opening for permitting liquid to pass in and out of the container. A support is centrally situated in the cover, the support having an upper margin situated at least as high as the circular rim portion. A closure member is formed unitarily with the cover and configured to seal the cover opening. A hinge permits the closure member to be pivoted between a position where the closure member is engaged in the cover opening and a position where the closure member is displaced from the cover opening. The hinge is molded unitarily to the upper margin of the central support in the cover.

8 Claims, 1 Drawing Sheet

CONTAINER LID WITH INTEGRAL STOPPER

BACKGROUND OF THE INVENTION

The present invention relates to lids for containers, the lid having a dispensing opening and a closure for the opening. More particularly, the present invention relates to a lid for a container configured to hold a liquid with the lid provided with a sloping cover portion which permits liquid exposed to the outer surface of the cover portion to flow back into the container.

Some conventional lids for containers designed to hold liquids, and especially lids for disposable coffee cups that are intended to be carried by the consumer, generally have a rim portion which is configured to engage the upwardly facing mouth of the container, and a cover portion which extends between the rim for sealing the container. Such lids can also have one or more openings formed in the cover portion to permit the liquid to be consumed from the container while the lid is in place on the container. Such openings in the lid are often not resealable in that, once the portion of the lid over the opening has been removed, that portion of the lid is generally not replaceable to reseal that opening. Additionally, in such conventional lids for coffee cups and the like, the cover portion is generally flat and often contains a number of discrete depressions. One problem with such a lid is that, should any of the liquid be splashed or otherwise exposed onto the top surface of the lid, the liquid normally remains on the lid and can be spilled onto the consumer.

Other conventional lids for containers designed to hold liquids, and especially lids for disposable coffee cups that are intended to be carried by the consumer, generally have one or more openings formed in the cover portion to permit the liquid to be consumed from the container while the lid is in place on the container, and a separate stopper adapted to reseal the opening which must be assembled to the lid. The assembly of the lid and stopper contributes significantly to the total cost of the whole container to the point that a meaningful economic disadvantage results.

Thus, one object of the present invention is to provide a lid for a container in which a resealable opening is provided on one side of the lid to permit liquid to be consumed from the container and to permit the opening to be resealed.

Another object of the present invention is to provide a lid for container in which liquid exposed to the outer surface of the lid will flow back into the container when the opening in the container is open.

Yet another object of the present invention is to provide a lid for a container in which an integral stopper is provided for permitting resealing of the container thereby avoiding any lid-stopper assembly.

SUMMARY OF THE INVENTION

A lid according to the present invention comprises a circular rim portion which includes means for sealingly engaging the edge of the opening. The lid also includes a cover portion which extends between the rim portion to cover the container opening, with the cover portion having an outer surface and an inner surface. The outer surface of the cover portion defines a plane which is at an angle to and below the plane defined by the circular rim, such that a first part of the cover is lower than a second part of the cover. An opening is formed in the first part of the cover which permits dispensing of the contents of the continer. The location of the opening also permits liquid which is exposed to the outer surface to flow by gravity toward the opening and through the cover into the container.

A closure member is formed unitarily with the lid and configured to seal the cover opening. A support for the closure member is centrally situated in the cover portion between the first and second parts of the upper surface, the support having an upper margin situated at least as high as the rim portion. Integral hinge means is porovided on the upper margin for permitting the closure member to be pivoted between a position where the closure member is engaged in the cover opening and a position where the closure member is displaced from the cover opening.

One feature of the foregoing structure is that the cover portion of the lid is angled such that a first part of the outer surface of the cover is lower than a second part of the outer surface. One advantage of this feature is that the outer surface of the cover portion has a low point which will collect any liquid exposed to the outer surface of the cover portion.

Another feature of the foregoing structure is that an opening is formed in the first part of the outer surface of the cover. One advantage of this feature is that, by providing an opening in the first, or lower part, of the cover portion, any liquid exposed to the outer surface of the cover portion will flow back into the container through the opening.

In preferred embodiments of the present invention, an integral resealable closure member is provided for selectively closing the cover opening. One feature of the foregoing structure is that the resealable closure member may be engaged and disengaged from the cover opening when desired. One advantage to this feature is that no assembly of the lid and closure member is required due to its integral character.

Also in preferred embodiments of the present invention, means for retaining the resealable closure in a fully open position are provided. One feature of the foregoing structure is that when the closure member is pivoted from the position where it is engaging the opening in the cover member to a fully open position where the closure member is displaced as far as possible from the cover opening, the closure member can be temporarily retained in the fully open position. One advantage of this feature is that the closure member is easily moved away from the cover opening and retained in the open position to permit access to the liquid in the container, and is also easily moved back into engagement with the cover opening to reseal the container.

Additional objects, features, and advantages of the present invention will be apparent to those skilled in the art upon consideration of the following detailed description of a preferred embodiment exemplifying the best mode of carrying out the invention as presently perceived.

DESCRIPTION OF THE PREFERRED EMBODIMENT

Figure 1:
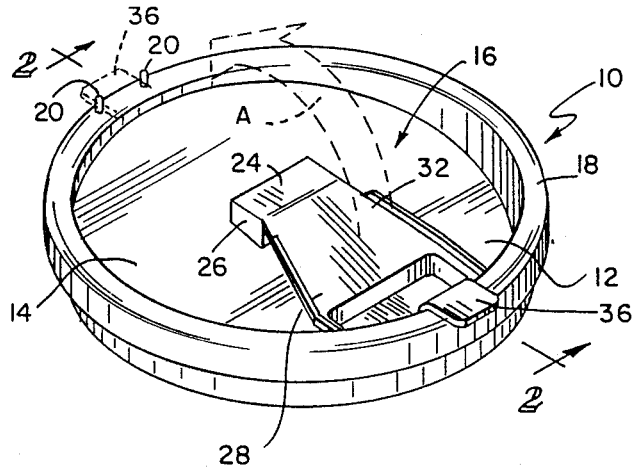
FIG. 1 is a perspective view of the container lid of the present invention.

A container lid 10 according to the present invention as shown in the drawings is designated for use with disposable containers typically used to hold coffee or other types of beverages. Such containers and lids are typically used to serve beverages purchased and taken from the place of purchase for later consumption by the consumer such as in an automobile. Typically such containers are formed from an insulating material such as expanded polystyrene or the like and are of a size to hold an amount of beverage normally purchased for consumption by one consumer, typically one to two cups.

The lid 10 includes a generally planar cover portion 16, including lower first part 12 and a higher second part 14, which is bounded by a rim portion 18. The rim portion 18 is configured to engage the upper edge of a container such that, when the lid 10 is properly installed on a container, the container is sealed. A cover opening 22 is formed in the lower side 12 of the cover portion 16 to permit the beverage within the container to be consumed by the consumer while the lid 10 is in place on the container 12.

An integral closure 28 is provided to selectively seal and unseal the cover opening 22. The closure 28 includes a closure portion 30 which is sized and configured to be received into the cover opening 22 to seal the cover opening 22. An arm or web portion 32 extends away from the closure portion 30 and includes a living hinge 34 integrally joining the closure 28 to a support 26 situated between the lower first part 12 and the higher second part 14 of the cover portion 16. The support 26 includes an upper surface 24 situated at least as high as the rim portion 18 with which the living hinge 34 is unitarily formed. The closure 28 is pivotable from a position where the closure portion 30 is engaged with the cover opening 22, as shown in FIG. 1, to a position fully displaced away from the cover opening 22 to permit access to the beverage within the container as shown in FIG. 3.

A lift tab 36 integrally attached to the closure 28 at its outer end permits the closure 28 to be urged upwardly in the direction of arrow A to move the closure portion 30 out of engagement with the cover opening 22. It will be understood that the closure portion 30 is configured to extend into the cover opening 22 a certain amount in order to provide an effective seal of the cover opening 22. Thus, the lift tab 36 is provided to permit the closure portion 30 to be lifted upwardly out of the cover opening 22 when access to the cover opening 22 is desired. Additionally, the lift tab 36 advantageously provides a means for securing the closure 28 in the fully open position shown in FIG. 3. The closure 28 is retained in the fully open position by protrusions 20 on rim 18 engaging the sides of lift tab 36. The character of the living hinge 34 is such that the closure 28 can be returned from the fully open position in the direction of arrow B to the fully closed position, shown in FIG. 1, many times without danger of fatigue failure.

Figure 2:
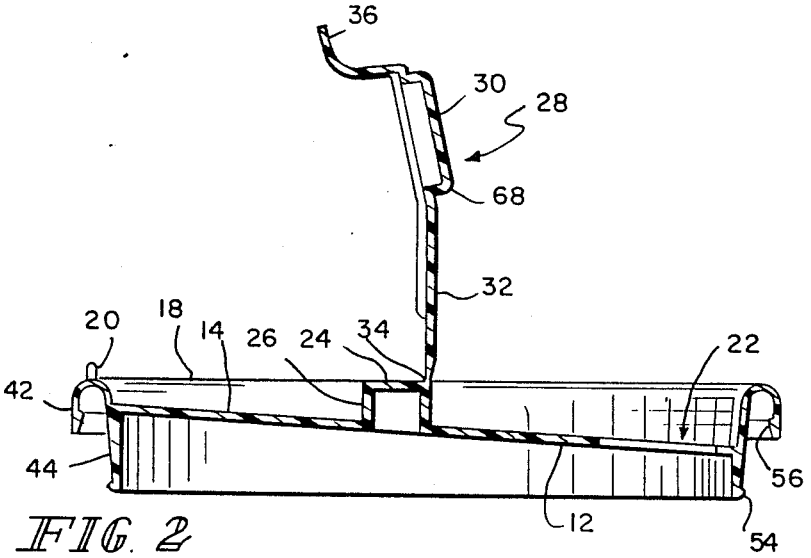
FIG. 2 is a sectional view taken along line 2—2 of FIG. 1 with the closure situated between a fully open position and a fully closed position.
Figure 3:
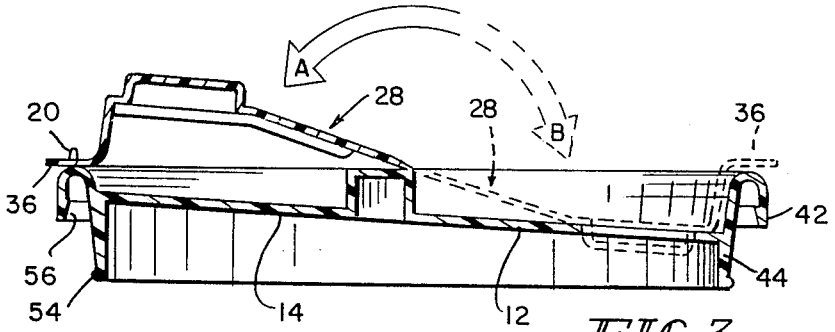
FIG. 3 is a sectional view similar to FIG. 2 but with the closure shown in solid in the fully open position and in phantom in the fully closed position.

FIGS. 2 and 3 show the inclined orientation of the cover portion 16 of the lid 10 relative to the rim portion 18 which permits liquid exposed to the cover portion 16 to flow back into the container 12 under certain circumstances. Additionally, the rim portion 18 is shown to include a downwardly extending outer wall 42 and a downwardly extending inner wall 44 which is in a somewhat parallel, spaced apart relation to the outer wall 42. The outer wall 42 and inner wall 44 are sized and configured to sealingly engage the sidewall of a container to which the lid 10 is attached. Specifically, the outer wall 42 and inner wall 44 are sized and configured to straddle an upper edge defining the mouth of the container. The inner wall 44 of the rim portion 18 includes an outwardly extending, small rib 54 which is sized and oriented to engage an inner surface of a container side wall. Likewise, the outer wall 42 includes an inwardly extending rib 56 which is sized and oriented to engage the outer surface of the container lip. The ribs 54 and 56 cooperate with the container side mouth to provide a liquid-tight seal between the lid 10 and the container.

As can be seen in FIGS. 2 and 3, the cover portion 16 is inclined with respect to and is located below the plane of the rim 18. This inclinatin of the cover portion 16 ensures that the first portion 12 of the cover portion 16 is lower than the second portion 14. Since the cover opening 22 is formed in the first lower portion 12, any liquid exposed to the upper surface of the cover portion 16 will flow by gravity toward the lower portion 12 and flow through the cover opening 22 into the container to which the lid 10 is attached.

To enable the closure portion 30 to fit snugly within the cover opening 22, the closure portion 30 is formed to include an angled face 68 around the perimeter of the closure portion 30. the angled face 68 permits the closure portion 30 to be sized such that a tight fit exists between the closure portion 30 and the cover opening 22 when the closure portion 30 is seated in the cover opening 22. The angled face 68 also permits the cover portion 30 to be easily aligned and inserted into the cover opening 22 even with the close dimensional relationship between the cover portion 30 and the cover opening 22.

The living hinge 34 of the closure 28 permits the closure portion 30 to be lifted away from the cover opening 22 when desired by the lift tab 36. The positioning of the living hinge 34 on the upper margin or surface 24 of central support 26 permits the lid 10 to be molded as a unitary structure thereby avoiding assembly of the closure 28 to the lid 10. Thus, the present invention provides a unitary lid and closure for a container in which any liquid exposed to the upper surface of the lid tends to flow back into the container when the container opening is exposed. Additionally, the container opening is resealable with the integral closure too permit selective opening and closing of the cover opening when desired.

Although the invention has been described in detail with reference to a preferred embodiment as specific examples, variaitions and modifications exist within the scope and spirit of the invention as defined in the following claims.

What is claimed is:

1. A lid for a container for holding a liquid, the container having an upwardly facing, generally planar opening bounded by an edge, the lid comprising:

a circular rim portion including means for sealingly engaging the container opening, the rim portion defining a first plane;

a cover portion within the rim portion to cover the container opening, the cover portion having an outer and inner surface, the outer surface defining a second plane situated below and at an angle to the first plane, a first part of the outer surface being closer to a container bottom position than a second part of the outer surface;

an opening formed in the first part of the cover portion and extending between the outer surface and the inner surface, whereby liquid which is exposed to the outer surface flows by gravity toward the first part of the outer surface and flows through the opening into the container;

a support centrally situated in the planar cover portion between the first part and the second part of the upper surface, the support having an upper margin situated at least as high as the first plane;

a closure member formed unitarily with the cover and configured to seal the cover opening; and hinge means for permitting the closure member to be pivoted between a position where the closure member is engaged in the cover opening and a position where the closure member is displaced from the cover opening.

2. The lid of a claim 1 further comprising a web portion situated between the closure member and the hinge means having a width comparable to the closure member overlying an area of the first part of the planar cover portion when the closure member is engaged in the cover opening.

3. A lid for a container having an upstanding side wall with an upper edge bordering a circular upwardly facing opening, the lid comprising:

a circular rim portion defining a first plane and including means for engaging the upper edge of the container;

a generally planar cover portion situated within the rim portion to completely cover the container opening when the lid is in place, the cover portion having an upper surface defining a second plane, the second plane being situated below and inclined with respect to the first plane such that a first part of the upper surface is farther from the upper edge than an opposite, second part of the upper surface, the planar cover portion having an opening in the first part of the upper surface through which liquid can be extracted from the container;

a central protrusion extending upperwardly from the planar cover portion between the lower first portion and an opposite higher second portion, the support having an upper margin situated at least as high as the first plane; and a closure member sized and configured to seal the cover opening, and means for pivotally mounting the closure member to the support upper margin to permit the closure member to be provided from a position where the closure member is engaged in the cover opening to a position where the closure member is displaced from the cover opening.

4. The lid of claim 3 wherein the mounting means comprises a living hinge defining a line along an upper surface of the support member.

5. The lid of claim 3 wherein the closure member further comprises a tab for lifting the closure member upwardly away from the cover opening.

6. The lid of claim 5 further comprising locking means situated on the rim portion opposite the opening for engaging the tab of the closure when the closure in a fully open position.

7. The lid of claim 3 wherein the closure member is resealable in the cover opening.

8. A lid and a container, the container having an upstanding side wall with an upper, circular edge that borders an upwardly facing opening, the circular edge defining a first plane, the lid comprising:

a circular rim portion that includes an inner wall and an attached outer wall, the inner wall and outer wall straddling the container edge, with the outer wall sealingly engaging an outer surface of the container side;

a generally planar cover portion having an outer surface and an inner surface, the cover extending between and sealingly attached to the rim inner wall, the cover portion defining a second plane below the first plane and inclined with respect to the first plane such that the planar cover portion includes a lower first portion and an opposite higher second portion, the lower first portion of the cover including an opening;

an upperwardly extending support centrally situated in the planar cover portion between the lower first portion and an opposite higher second portion, the support having an upper margin situated at least as high as the first plane; and a closure member formed unitarily with the cover and configured to seal the cover opening, and means for pivotally mounting the closure member to the support upper margin to permit the closure member to be pivoted between a position where the closure member is engaged in the cover opening and a position where the closure member is displaced from the cover opening.

* * * * *

UNITED STATES PATENT AND TRADEMARK OFFICE

CERTIFICATE OF CORRECTION

PATENT NO. : 4,949,865

DATED : August 21, 1990

INVENTOR(S) : Turner, D.

It is certified that error appears in the above-identified patent and that said Letters Patent is hereby corrected as shown below:

In column 4, line 18, replace "inclinatin" with --inclination--.

In column 4, line 29, replace "the" (first occurrence) with --The--.

In column 4, line 49, replace "too" with --to--.

In column 4, line 54, replace "variaitions" with --variations--.

In column 6, line 2, replace "provided" with --pivoted--.

In column 6, line 36, replace "upperwardly" with --upwardly--.

Signed and Sealed this

Eighteenth Day of February, 1992

*Attest:*

HARRY F. MANBECK, JR.

*Attesting Officer*

*Commissioner of Patents and Trademarks*